US005161385A

United States Patent [19]

Schumacher

[11] Patent Number: 5,161,385

[45] Date of Patent: Nov. 10, 1992

[54] REFRIGERANT RECOVERY AND RECYCLE SYSTEM WITH FLEXIBLE STORAGE BAG

[76] Inventor: Ernest W. Schumacher, 212 Willow Creek La., Ovilla, Tex. 75154

[21] Appl. No.: 670,589

[22] Filed: Mar. 18, 1991

[51] Int. Cl.[5] ..... F25B 49/00

[52] U.S. Cl. ..... 62/127; 62/85; 62/149; 62/292; 62/475

[58] Field of Search ..... 62/77, 85, 292, 149, 62/474, 475, 125, 129, 127

[56] References Cited

U.S. PATENT DOCUMENTS 4,805,416 2/1989 Manz et al. ..... 62/292

4,969,495 11/1990 Grant ..... 62/292

*Primary Examiner*—Albert J. Makay

*Assistant Examiner*—J. Sollecito

[57] ABSTRACT

An improved refrigerant recovery and recycle system is disclosed. Refrigerant vapor, refrigerant liquid and oil entering the system from a refrigerant circuit being discharged are separated into liquid and vapor phases at near atmospheric pressure. Any remaining liquid refrigerant is vaporized within the phase separation means (5) by heat from the surrounding environment. Oil free refrigerant vapor flows through a selective adsorption column (8), which removes gaseous contaminants and water vapor, into a flexible membrane variable volume storage container (14) where it is confined at atmospheric pressure. Inventory of refrigerant vapor within the container is continuously monitored by means of a weight scale (15) which is adapted to compensate for the buoyancy of the surrounding atmosphere. Any air that enters the system stratifies at the top of the container (14) and is eliminated by operation of a piston pump (26). A comparative thermal conductivity detector (24) monitors the contaminant concentration of the fluid being purged. An oil-free compressor (17) facilitates recycling of the recovered refrigerant vapor through the purification process and provides the elevated vapor pressure necessary to accomplish transfer of the recycled refrigerant vapor from the system to an operating refrigerant circuit. An ejector pump (47) provides a means of evacuating refrigerant circuits being discharged to sub-atmospheric pressure.

16 Claims, 1 Drawing Sheet

REFRIGERANT RECOVERY AND RECYCLE SYSTEM WITH FLEXIBLE STORAGE BAG

TECHNICAL FIELD

This invention relates to an improved refrigerant recovery and recycle system for simple and safe use in servicing air conditioning and refrigeration systems, particularly those refrigerant circuits that contain CFC's as working fluids.

BACKGROUND OF THE INVENTION

Halogenated hydrocarbons with high vapor pressure at ambient temperature have historically been contained in heavy steel cylinders. One of the reasons for this means of containment is to minimize the space required for storage and transportation.

Scientific evidence supporting the theory of ozone depletion caused by the chlorine contained in many of these compounds has lead to regulations which limit the manufacture and discharge to atmosphere of many of the compounds within the group. Several of the environmentally unacceptable compounds are used as working fluids in refrigeration and air conditioning systems.

These circumstances have resulted in governmental regulations requiring the recovery, purification and reuse of chlorine containing refrigerants presently installed in working systems when the systems are opened for repair or are decommissioned.

State of the art recovery systems described in U.S. Pat. Nos. 4,805,416 4,768,347 4,809,520 4,878,356 4,938,031 include heavy and costly compressors, vessels, valves and piping to produce and contain the high pressures these systems must work at to liquify the recovered refrigerant. The bodily injury hazards related to the handling of high vapor pressure volatile liquid refrigerants have been clearly demonstrated by the many accidents that have occurred.

Leakage of the environmentally damaging compounds is aggravated by the high pressures and by system complexity. The liquefaction process consumes energy not otherwise required to accomplish the recovery, purification and reuse objectives.

SUMMARY OF THE INVENTION

An object of the present invention is to provide a refrigerant recovery and purification system that stores and processes the recovered refrigerant in the vapor phase at low pressure and ambient temperature.

Another object of the present invention is to provide a system that removes oil, moisture, air and other contaminants from the recovered refrigerant.

Another object of the present invention is to provide a system that facilitates transfer of the purified refrigerant into an operational refrigeration circuit.

Another object of the present invention is to provide a recovery and purification system that eliminates the safety hazards associated with the containerization and processing of high vapor pressure volatile liquids.

In accordance with one aspect of the invention a flexible membrane variable volume container is provided as a low pressure vapor storage means.

In accordance with another aspect of the present invention a column packed with granulated or beaded solid absorbent material is provided. The recovered refrigerant vapor is passed through the column wherein the sorbent selectively sorbs water vapor and other contaminating gases from the refrigerant vapor stream.

In accordance with another aspect of the invention an oil free compressor is provided to facilitate the transfer of the recovered and purified refrigerant vapor from the recovery system to an operational refrigeration circuit.

In accordance with another aspect of the invention a means of separating liquid refrigerant and oil from the refrigerant stream entering the recovery system from the refrigeration circuit being discharged is provided. Phase separation is accomplished by change of flow direction at low fluid velocity followed by coalescing filtration.

In accordance with other aspects of the invention necessary piping, fittings, valves, instruments and supporting structures are provided to facilitate the proper regulation and control of the recovery, purification, storage and transfer processes.

BRIEF DESCRIPTION OF THE DRAWING

For a more complete understanding of the present invention and the advantages thereof, reference is now made to the following description taken in conjunction with the accompanying drawing, in which.

DETAILED DESCRIPTION

Figure 1:
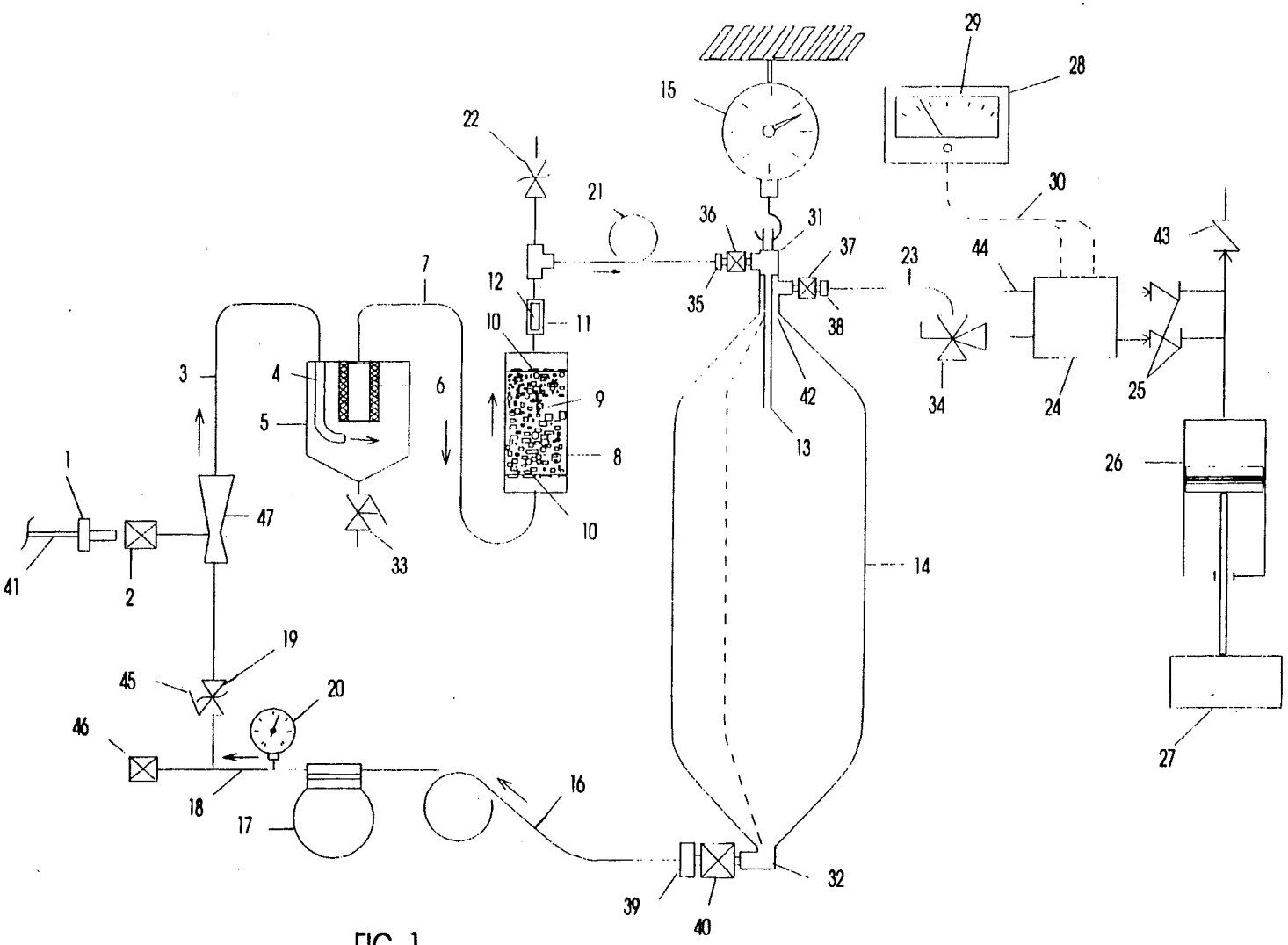
FIG. 1 is a schematic diagram of the system describing the preferred embodiment of the present invention.

With reference to FIG. 1, a refrigerant recovery and reclaim system is schematically illustrated which forms a first embodiment of the present invention. The recovery function of the system is initiated by connecting the refrigerant circuit to be discharged to the system through flexible tube 41 by inserting self-sealing quick coupler male portion 1 into self-sealing female portion 2. As portions 1 and 2 are fully engaged and locked together their internal valve mechanisms are automatically opened creating a passage through which the refrigerant being recovered flows into the recovery and reclaim system. The flow of recovered refrigerant from the pressurized refrigerant circuit being discharged into the recovery system continues until the refrigerant circuit pressure equilibrates with the recovery system pressure which remains at very near atmospheric pressure or the process is stopped by disconnecting quick coupler male portion 1 from portion 2 thereby allowing their internal valve means to reseat.

The fluid flowing into the system through quick coupler female portion 2 is conducted to accumulator vessel 5 through ejector 47, tube 3 and internal tube 4. Tube 4 is shaped and positioned within vessel 5 so that it directs the entering fluid onto the inside wall of the vessel in a tangential flow pattern. The described flow pattern and the reduced velocity within vessel 5 allow any liquid phase entrained in the refrigerant flow stream to impinge on the internal vessel surfaces and drop to the sump at the bottom of the accumulator vessel. The refrigerant vapor phase flows upward through coalescing filter 6 which filters any entrained liquid droplets or mist from the vapor stream.

The liquid free refrigerant vapor is conducted away from filter 6 through tube 7 to the entrance of desiccant column 8 which is comprised of a cylindrical enclosure surround a selected blend of solid sorbents 9 such as molecular seives, activated alumina and activated carbon securely retained between screens and fiberglass or felt filter pads 10. As the refrigerant vapor flows through the solid sorbent bed water vapor and other gaseous contaminants such as hydrogen chloride are selectively adsorbed and retained. The purified refrigerant vapor exiting desiccant column 8 passes through transparent tubular section 11 which contains a cobalt salt based colormetric moisture indicating element which facilitates continuous monitoring of the water vapor concentration remaining in the refrigerant vapor stream.

The purified refrigerant vapor stream is conducted through flexible tube 21, self-sealing quick coupler male portion 35, self-sealing quick coupler female portion 36, elbow 31 and quill 13 into flexible membrane variable volume storage container 14 where it resides at atmospheric pressure and ambient temperature until it is removed for recycling through the purification process or for installation into an operational refrigerant circuit. The storage container may be constructed from a variety of elastomeric or flexible plastic materials such as buna N or neoprene synthetic rubber compounds or polyvinyl chloride thermoplastic. The specific material selection is dependent on the compatibility of the material with the refrigerant compound or group of compounds with which it will be used.

Connecting tubes 16, 21 and 23 are flexible so that container 14 is mobile enough to facilitate the continuous monitoring of the weight of the container and its contents by scale 15. The specific gravities of the commonly used halogenated hydrocarbon refrigerant vapors are in the range of 4 to 5 which allows convenient weighing in air with simple buoyancy compensation techniques.

When the transfer or refrigerant from the refrigeration circuit being discharged to the recovery and reclaim system of this invention is complete because the pressure differential between the circuit and the system approaches zero or the transfer process must be stopped because the recovery system has been filled with refrigerant vapor to its capacity, the system and circuit are disconnected from each other by unlocking and removing self-sealing quick coupler male portion 1 from female portion 2. The separation of male portion 1 from female portion 2 causes the internal valve mechanisms in both coupling portions to automatically re-close and isolate both the system and the circuit from atmosphere.

Air and other low density contaminating gases will stratify at the top of the storage container during undisturbed storage. The collected low density contaminating gases can be manually purged through annulus 42, self-sealing quick coupler female portion 37, self-sealing quick coupler male portion 38, flexible tube 23, three way manual valve 34, comparative thermal conductivity detector 24, check valves 25, by positioning valve 34 to connect tube 23 to thermal conductivity detector 24 and initiating operation of weight driven piston pump 26. Pump 26 maintains a constant suction pressure at the exit connections of check valves 25 by the action of weight 27 on the pump piston causing a constant pressure differential to be maintained across the piston during its downward stroke. The constant suction pressure maintained by the weight driven pump causes constant flow through flow control orifices located in each chamber of the thermal conductivity detector thereby maintaining precisely regulated flow rates through the comparative detectors. When the pump reaches the bottom of its downward stroke purge flow stops. The relationship between the pump displacement, orifice sizes and mass of weight 27 is carefully designed to provide slowly moving downward pump strokes with durations of one to three minutes. If additional purging is required after the pump reaches the bottom of its downward stroke, another cycle of weight driven pump operation is initiated by manually moving the weight and piston to its uppermost position and releasing it. The upward movement of the piston causes the purged gas contained in the pump cylinder to be expelled through check valve 43. During the withdrawal of gas from the system the contamination level is continuously monitored by the comparative thermal conductivity detector. Unbalance within the wheatstone bridge of the detector system is presented by instrument 28 on meter 29. Wires 30 provide the necessary electrical connections between the detector cells and instrument 28. Unbalance in the detector's wheatstone bridge is proportional to the contamination level in the gas stream flowing. The reference gas used is air which enters the reference cell at entrance port 44. Three way valve 34 is provided to enable simultaneous air flow through both chambers of the detector for calibration purposes and to isolate the system from atmosphere when the purge system is not in use.

Recycling of the refrigerant vapor contained in flexible container 14 may be accomplished by energizing electrically driven oil-less compressor 17 which withdraws refrigerant vapor from flexible container 14 through elbow 32, self-sealing quick coupler female portion 40, self-sealing quick coupler male portion 39 and flexible tube 16. Refrigerant vapor entering the compressor 17 through flexible tube 16 is compressed and discharged into tube 18 wherein the pressure is continuously monitored by pressure gauge 20. The compressed refrigerant vapor flows through tube 18 to the entrance of differential pressure regulating valve 19. Low pressure recycling of the refrigerant vapor is enabled by holding differential pressure regulating valve 19 continuously open by moving manual operating lever 45 to the latched open position. Self-sealing quick coupler female portions 46 and 2 are closed by their reseating internal valve mechanisms while there is no male portion engaged. Refrigerant vapor thence flows from the exit of valve 19 into tube 3 and recycles through the purification processes heretofore described until the required moisture level as monitored by moisture indicating element 12 is achieved.

When the adsorbents 9 become saturated with contaminants they are replaced with activated adsorbents to maintain the purification process capability.

During the recycle mode the compressor 17 is operated continuously. The refrigerant pressure in flexible container is approximately equal to atmospheric pressure. The pressure at the suction connection of compressor 17 is slightly sub-atmospheric due to the pressure loss caused by the flow between container 14 and compressor 17. The pressure at the discharge connection of compressor 17 is the highest pressure in the system and is slightly super-atmospheric due to the pressure loss caused by flow between compressor 17 and flexible container 14. It can be understood by those skilled in the art that the magnitude of the differential pressures described can be predictably controlled by system design. The pressure in the refrigeration circuit being discharged can be reduced to sub-atmospheric pressure through tube 41 by inserting quick coupler male portion 1 into quick coupler female portion 2 and locking them together to establish a flow passage as here in before described, positioning pressure regulating valve 19 in the latched open position with manual operating lever 45 and energizing electric motor driven compressor 17. The compressor operation provides forced circulation of the refrigerant vapor contained within the system through valve 19 and the primary nozzle of fluid powered ejector 47 into tube 3 and the rest of the system as in the recycle process described earlier. Flow of refrigerant vapor through the primary nozzle of ejector 47 generates reduced pressure at the throat of the ejector at which point the exit of quick coupler female portion 2 is connected. Operation of the system in the described mode causes continued evacuation of the refrigerant circuit being discharged. The final sub-atmospheric absolute pressure that the refrigerant circuit can be reduced to depends on the design of the ejector and the length of time the system is operated in the evacuation mode.

Refrigerant vapor contained in the recovery and recycle system of this invention can be conveniently and safely charged into an operational refrigerant circuit by connecting the refrigerant circuit through tube 41 to the system by inserting self-sealing quick coupler male portion 1 into self-sealing quick coupler female portion 46 and locking them together thereby causing their internal valve mechanisms to automatically move to the open position creating an open flow passage between the system and the refrigerant circuit. Valve 19 is placed in the differential pressure regulating mode by releasing manual operating lever 45 and electric motor driven compressor 17 is energized. The pressure in tube 18 is elevated to the preset relief value of differential pressure regulating valve 19 by the action of compressor 17. Any further increase in pressure in tube 18 will be relieved through valve 19 and recycled as heretofore described. The flow capacities of compressor 17 and valve 19 are balanced at the elevated operating pressure by system design. The elevated pressure in tube 18 causes flow through self-sealing quick coupler portions 46 and 1 and through tube 41 to the connected refrigerant circuit being charged and continues as long as the pressure in tube 18 exceeds the pressure in the refrigerant circuit being charged. The refrigerant vapor can be safely charged into the low pressure side of the refrigerant circuit thereby minimizing the pressure required in tube 18. Those skilled in the operation and repair of refrigeration equipment have the capability of accomplishing the low pressure side charging procedure described.

Manual lever operated valve 33 facilitates draining trapped oil and other liquids from accumulator vessel 5 and pressure relief valve 22 protects the system from over pressurization.

What is claimed:

1. A refrigerant recovery and purification system which recovers, purifies and stores the refrigerant in the vapor phase at very near atmospheric pressure, the system comprising;

a flexible membrane variable volume storage container for confining the recovered refrigerant vapor at atmospheric pressure and ambient temperature;

means positioned in the storage container entrance flow path for separating liquid from the refrigerant stream;

means positioned intermediate the liquid separation means and the storage container entrance for separating water vapor and acid forming gases from the refrigerant vapor stream by selective adsorption;

a compressor positioned in the storage container exit flow path to provide forced circulation of the refrigerant vapor for recycling through the purification process and for elevating the pressure to facilitate transfer of the refrigerant vapor from the system to an operational refrigerant circuit;

a differential pressure regulating valve positioned between the compressor exit and the liquid separation means to maintain a stable elevated pressure in the portion of the system between the compressor exit and the regulating valve entrance;

a pressure relief valve positioned to prevent overpressurization of the system;

a pressure gauge positioned to indicate system pressure at the exit of the compressor;

a balance or weight scale positioned to support and indicate the weight of the variable volume storage container and its contents.

2. The system of claim 1 wherein the variable volume storage container is constructed of a synthetic elastomeric material from the group comprising viton, epdm, buna-n, neoprene, nitrile, hypalon and chlorinated buna-n.

3. The system of claim 1 wherein the liquid separation means is comprised of a cylindrical inertial separation vessel with tangential entry and a coalescing filter positioned in the flow stream exiting the vessel.

4. The system of claim 1 wherein the means for selectively adsorbing water vapor and acid forming gases from the refrigerant vapor is comprised of a column of granulated solid adsorbent material including one or more of the group comprising molecular sieves, activated alumina, silica gel, activated carbon and naturally occurring zeolite retained between fiberglass filter pads supported by perforated metal or plastic partitions contained within a cylindrical metal or plastic vessel having both ends enclosed and fitted with tubing connectors.

5. The system of claim 1 wherein said compressor is oil-less.

6. The system of claim 1 wherein the differential pressure regulating valve is comprised of a flat faced spring loaded valve member positioned to rest on a seat surrounding the valve orifice. The operating pressure differential is fixed by setting the spring force to balance the selected differential pressure exerted over the orifice area. The valve is arranged in either the globe or angle valve flow pattern and is fitted with a lever operated cam mechanism which is arranged to overcome the spring load and lock the valve in the open position at the operators option.

7. The system of claim 1 wherein the variable volume storage container is constructed of synthetic polymer selected from the group including polyvinyl chloride, chlorinated polyvinyl chloride, polyethylene, polypropylene, polyvinyl alcohol, polyvinylidene chloride, nylon, polyester, aluminized polyester and polytetrafluoroethylene.

8. The system of claim 3 wherein the bottom of said separation vessel is provided with a drain valve.

9. A refrigerant recovery and purification system which recovers, purifies and stores the refrigerant in the vapor phase at very near atmospheric pressure, the system comprising;

a flexible membrane variable volume storage container for confining the recovered refrigerant vapor at atmospheric pressure and ambient temperature;

means positioned in the storage container entrance flow path for separating liquid from the refrigerant stream and draining it from the system;

means positioned intermediate the liquid separation means and the storage container entrance for separating water vapor and acid forming gases from the refrigerant vapor stream by selective adsorption;

a compressor positioned in the storage container exit flow path to provide forced circulation of the refrigerant vapor for recycling through the purification process and for elevating the pressure to facilitate transfer of the refrigerant vapor from the system to an operational refrigerant circuit;

a differential pressure regulating valve positioned between the compressor exit and the liquid separation means to maintain a stable elevated pressure in the portion of the system between the compressor exit and the regulating valve entrance;

a fluid powered ejector pump positioned to receive vapor exiting said differential pressure regulating valve at the entrance of the ejector primary nozzle. The suction connection of said ejector is connected to the system inlet which communicates with the refrigerant circuit being discharged;

moisture indicating means positioned to monitor the moisture content of the refrigerant vapor stream exiting said water vapor separation means;

purge means for discharging air and other low molecular weight gases from the system to atmosphere.

a pressure relief valve positioned to prevent overpressurization of the system.

a pressure gauge positioned to indicate system pressure at the exit of the compressor.

a balance or weigh scale positioned to support and indicate the weight of the variable volume storage container and its contents.

10. The system of claim 9 wherein said ejector pump has a low differential pressure check valve positioned to prevent outflow through the suction connection of the pump.

11. The system of claim 9 wherein the moisture indicating means is a colormetric indicator comprised of a paper element impregnated with cobalt salts mounted in a transparent plastic or glass window and positioned to be fully exposed to the refrigerant vapor flow within the system.

12. The system of claim 9 wherein said purge means is positioned to withdraw vapor from the top of the flexible storage container by the action of a manually operated weight driven piston pump which discharges to atmosphere. A comparative thermal conductivity detector is positioned in the purge flow passage intermediate the storage container and said pump. A three way valve, intermediate the storage container and the conductivity detector, has a first and second inlet and a single outlet which is connected to the inlet of one of the identical detector cells. The first inlet is connected to the flow path of the withdrawn vapor, the second inlet is open to atmosphere. The valve pattern permits only one valve inlet to be open at a time. The inlet of the second identical detector cell is always open to atmosphere to provide the reference gas which is air.

13. The system of claim 12 wherein the weight driven pump is a single acting pump oriented so that piston motion is vertical and configured so that the suction stroke is downward and weight driven. The discharge stroke is upward and is powered by hand or other suitable means.

14. The system of claim 12 wherein said comparative thermal conductivity detector comprises a housing containing two flow cells each fitted with one of a matched pair of thermistors located in the flow stream. Each cell is fitted with an identical orifice. The outlet of both cells are connected through low differential pressure check valves to the common suction of the weight driven pump.

15. The system of claim 14 wherein said matched thermistors are arranged in a wheatstone bridge.

16. The system of claim 15 wherein said wheatstone bridge is monitored by suitable electrical instrumentation to detect changes in bridge balance.

* * * * *